US005183694A

United States Patent [19]

Webb

[11] Patent Number: 5,183,694

[45] Date of Patent: Feb. 2, 1993

[54] INHIBITING CORROSION IN REINFORCED CONCRETE

[76] Inventor: Michael G. Webb, 18 Broadoak Road, Bramhall, Cheshire SK7 3BL, Great Britain

[21] Appl. No.: 598,722

[22] PCT Filed: Apr. 19, 1988

[86] PCT No.: PCT/GB89/00404

§ 371 Date: Oct. 19, 1990

§ 102(e) Date: Oct. 19, 1990

[87] PCT Pub. No.: WO89/10435

PCT Pub. Date: Nov. 2, 1989

[30] Foreign Application Priority Data

Apr. 19, 1988 [GB] United Kingdom ..... 8809230

[51] Int. Cl.[5] ..... B32B 3/02

[52] U.S. Cl. ..... 428/67; 428/76; 428/209; 405/214; 405/216; 204/147; 204/196

[58] Field of Search ..... 405/211, 216; 204/147, 204/196; 428/67, 76, 209; 156/60

[56] References Cited

U.S. PATENT DOCUMENTS

| | | | |
|---|---|---|---|
| 3,992,272 | 11/1976 | Maxson et al. | 204/196 |
| 4,812,212 | 3/1989 | Dimond et al. | 204/196 |
| 4,855,024 | 8/1989 | Drachnik et al. | 204/196 |
| 4,880,517 | 11/1989 | Bennett et al. | 204/147 |
| 4,900,410 | 2/1990 | Bennett et al. | 204/196 |
| 4,931,156 | 6/1990 | Dowd et al. | 204/196 |
| 4,957,612 | 9/1990 | Stewart et al. | 204/196 |

FOREIGN PATENT DOCUMENTS

| | | |
|---|---|---|
| 0147977 | 7/1985 | European Pat. Off. . |
| 0292428 | 11/1988 | European Pat. Off. . |

*Primary Examiner*—Patrick J. Ryan
*Assistant Examiner*—Abraham Bahta
*Attorney, Agent, or Firm*—Salter, Michaelson & Benson

[57] ABSTRACT

There is disclosed apparatus of and a method for inhibiting corossion of reinforcement in a reinforced structure wherein one or more anodes (3) are arranged adjacent a surface of the structure (1) to be protected and a body of ionically conductive cementitious material (6) is arranged to suround the anodes and make contact with ionically conductive cementitious material of the structure (1), said body of ionically conductive cementitious material (6) being surrounded by a cover (4) of moisture resistant substantially non-porous material to maintain said material (6) in an ionically conducting condition. Said electrodes (3) and reinforcement (2) within the body (1) can be electrically connected to cause a current to pass through said two sorts of ionically conductive cementitious material to protect the reinforcement (2) against electrolytic corrosion.

19 Claims, 4 Drawing Sheets

INHIBITING CORROSION IN REINFORCED CONCRETE

This invention relates to a method for inhibiting corrosion of reinforcement in structures of masonry or cementitious material, especially (but not only) concrete, and includes apparatus for doing so, methods of installing such apparatus, assemblies for use in such apparatus, and methods of inhibiting corrosion using such apparatus.

Masonry or cementitious materials usually have compressive strength, but little tensile strength It is therefore necessary when using concrete, for example, as a structural member to incorporate reinforcing members (usually metal, preferably steel) to impart the required tensile strength. The reinforcing members may be placed under tension to form "pre-stressed" or "post-tensioned" concrete structures.

If the reinforcement corrodes, it may expand and cause internal stresses within the concrete. This ultimately leads to cracking of the concrete which is then liable to start breaking up. The cracking also results in the reinforcement being further exposed to water and atmospheric oxygen, accelerating the corrosion process.

Rusting is a complex electrolytic process whereby ferrous metal is oxidised to the corresponding oxides and hydroxides of iron, generally by atmospheric oxygen in the presence of water. In fresh concrete the pH is typically in the range of 12–14, this high alkalinity being a result of the formation of hydroxides of sodium, potassium and calcium, upon the hydration of cement.

Under such conditions steel is passive, this passivation leading to long term stability and protection of the reinforcing member from corrosion.

However, when such passivated reinforcement is exposed to either a strong Lewis base e.g. chloride ions and/or a loss of pH to below 10, the passivation can be disrupted and the steel reinforcement subjected to corrosion. An example of the former is the introduction of chlorides into the concrete matrix by either road salt usage, exposure to the marine environment, or the use of salt-contaminated aggregate or calcium chloride hardening accelerators in the original mix.

These agents have caused widespread corrosion-related damage in many structures including bridge piers, decks, and crossheads, marine piers and harbor structures, and many pre-1970's pre-cast concrete building elements in which chloride-based accelerators were used to improve the economics of their manufacture.

Another cause of corrosion is carbonation of the concrete by penetration of carbon dioxide from the atmosphere which reacts with the pore water in the concrete to form carbonic acid which in turn neutralises the soluble hydroxides and reacts with the calcium hydroxide present depositing calcium carbonate:

$$Ca(OH)_2 + H_2CO_3 \rightarrow CaCO_3 + 2H_2O \quad (1)$$

$$CaCO_3 + CO_2 + H_2O \rightarrow Ca(HCO_3)_2 \quad (2)$$

Formation of the bicarbonate shown in the above reaction (2) enables additional $CO_2$ made available by diffusion from the atmosphere to react with further calcium hydroxide in the cement.

Carbonated concrete exhibits a sufficiently low pH at which point steel passivation is not stable.

Carbonation takes place at a rate which depends upon a variety of factors such as the original cement content of the concrete, the water:cement ratio of the concrete, aggregate type and grading, density and compaction, and the aspect and degree of protection afforded to the concrete surface. The net result of the carbonation process is however that ultimately the alkalinity which protects the metal from rusting is reduced and the rusting process will start. The reduction in alkalinity is further compounded by acid pollutants in the air such as oxides of sulphur and nitrogen.

In good quality concrete with correct placement of the reinforcement, problems of corrosion resulting from carbonation may not occur for fifty years or even longer. This period can be extended by the use of anti-carbonation coatings on the outer surface of the concrete which help to exclude carbon dioxide and other acidic atmospheric pollutants. There are however many structures where metal corrosion is inevitable and cannot easily be checked. Surface coatings which restrict the entry of carbon dioxide are not as effective if the carbonation depth prior to the application of the coating has already reached or passed the first metal reinforcements or if chloride ion is present in the concrete.

It is well known to protect an electrically conductive substrate from corrosion by establishing a potential difference between the substrate and a spaced-apart electrode. The substrate and the electrode are connected to each other through a power supply of constant sign (DC or rectified AC) and the circuit is completed when electrolyte is present in the space between the substrate and the electrode. In most such impressed current systems, the substrate is the cathode (i.e. that electrode at which reduction reactions occur). However, with substrates which exhibit a stable passive state, e.g. Ni, Fe, Cr and Ti and their alloys, it is also sometimes possible to use impressed current systems in which the metal is the anode. In both cathodic and anodic systems, the substrate is often provided with a protective insulating coating; in this case the impressed current flows only through inherent porosity or accidentally exposed portions of the substrate. If the system is to have an adequate life, the electrode must not itself be corroded at a rate which necessitates its replacement; this is in contrast to the "sacrificial anodes" which are used in galvanic protection systems. The electrode must also have a surface which is not rendered ineffective by the current passing through it or by the electrochemical reactions taking place at its surface, such as the evolution of oxygen and possibly chlorine gas.

Many conventional impressed current corrosion protection systems make use of a plurality of discrete electrodes which are spaced apart at some distance from the substrate. Typically, the anodes are rigid rods which are composed of (a) graphite or (b) silicon iron or catalysed valve metals. Because of the distance between the electrodes and the substrate, large power supplies are often needed and interference from other electrical systems (including other corrosion protection systems) is common. In addition, the high current density at the electrode can give rise to problems, e.g. in dispersing gases generated by electrochemical reactions at the surface of the electrode.

U.S. Pat. No. 4,502,929 describes advantageous electrodes whose electrically active outer surface is provided by an element which is composed of a conductive polymer and which is at least 500 microns, preferably at least 1000 microns, thick. The term "conductive polymer" is used herein to denote a composition which comprises a polymer component and, dispersed in the polymer component, a particulate conductive filler which has good resistance to corrosion, for example catalytic titanium sponge particles as described in U.S. Pat. No. 4,454,169, or especially carbon black or graphite.

These advantageous electrodes may be incorporated in a mass of reinforced concrete to impress a corrosion-resisting current on the reinforcement, or may be applied to a surface of the mass and covered by a further layer of concrete as described in Published European patent application 0147977.

An object of the present invention is to provide a corrosion protection system which can be more conveniently applied to existing reinforced structures, avoiding the need to cover the surface with a further layer of concrete Such overlays are often unacceptable in view of weight and space considerations in an existing building structure a reinforced The invention accordingly provides a reinforced structure of masonry or cementitious material having apparatus for inhibiting corrosion of reinforcement thereof, comprising a pattern of two or more assemblies located on a surface of the structure, each of which comprises a surface of the (a) one or more electrodes overlying structure material
(b) ionically conductive cementitious grouting connecting the electrode(s) to the said surface; and
(c) a moisture-resistant cover having a moisture vapor transmission rate of less than $10^3$ g mil per $m^2$ per 24 hours overlying the electrode(s) and the grouting material, an edge portion of which cover extends partly around the electrode(s) and the grouting material towards the said surface of the reinforced structure.

It will be understood that the term "grouting material" is applied herein to the ionically conductive cementitious grouting material for convenient reference and is not intended to imply any limitation of that material to compositions known to be used for "grouting" in other circumstances or contexts. The term however specifically excludes flexible polymeric gels, whose function (hereinafter described) is unlike that of grouting. The ionic conductivity will preferably result from the presence of water and mobile ions in the grouting material, rather than from any inherent conductivity of the solid masonry or cementitious components themselves. However, conductive fillers, for example carbon or graphite, which are known as additives to concrete and conventional grouting materials, can also be used and may enhance the performance of the anode in some cases.

The invention also provides a method of repairing a reinforced structure of masonry or cementitious material and providing it with a cathodic protection system, comprising:

(a) removing any unsound masonry or cementitious material and if necessary trimming the remaining structure t provide a profile suitable for the following steps,
(b) attaching to the a surface of the structure at least one assembly which comprises at least one electrode and a preformed cover having a moisture vapor transmission rate of less than $10^3$ g mil per $m^2$ per 24 hours so as substantially to enclose the electrode(s) between the cover and the said structure,
(c) introducing ionically conductive masonry or cementitious grouting material into the space enclosed between the cover and the said structure, and
(d) causing or allowing the grouting material to harden; thereby connecting the electrode(s) to the said structure and repairing or replacing portions of the said structure.

As a further aspect the invention provides a preformed article for application to the surface of a reinforced structure to inhibit corrosion of the reinforcement therein, the article comprising:

(a) one or more electrodes capable of serving as active anode(s) in operation,
(b) ionically conductive grouting material in contact with the electrode(s) which grouting material is capable of permitting the electrochemical reactions necessary to inhibit corrosion.
(c) a moisture-resistant cover having a moisture vapor transmission rate of less than $10^3$ g mil per $m^2$ per 24 hours extending at least partly around the electrode(s) and grouting material, an edge portion of which cover will extend towards the surface to which the article is to be applied in use, and optionally,
(d) electrical connector(s) for connecting the electrode(s) to a power supply and/or to each other in use, and
(e) means for mechanically attaching the cover to the reinforced structure.

The following description will refer, for simplicity, simply to concrete, but the invention is applicable generally to structures of masonry material, (e.g. natural or artificial stone, non-cementitious "mortars" or "concretes" which set by reaction with atmospheric carbon dioxide, or brickwork), as well as to cementitious material, e.g. concrete, "microconcrete" (having no large aggregate), mortars or renders.

The form of the electrode(s) is not critical, but it is preferable to use elongate electrodes of the advantageous kind described in the aforementioned U.S. Pat. No. 4,502,929, the disclosure of which is incorporated herein by reference, preferably comprising a single conductor wire substantially concentrically surrounded by the conductive polymer composition. Other forms of these electrodes comprising one, two or more wires embedded in the conductive polymer composition may also be used. Metal mesh or wire electrodes may also be useful in some circumstances.

Electrodes may comprise titanium or platinum wire, graphite rods, catalytic ceramic tiles, carbon fiber yarns, or valve metal wire coated oxide or an electrocatalytic coating for example a spinal ceramic or other conductive containing a noble metal catalyst, as described for example in published International patent applications WO8500838 and WO8600758, U.S. Pat. No(s). 4,517,068 and 4,402,996, British Pat. No. 1329855 or Canadian Pat. No. 923069, the disclosures of all of which are incorporated herein by reference.

The moisture-resistant cover could be formed in situ, e.g. by coating the grouting material with 0.1 to 10 millimeters thickness of suitable film-forming composition (e.g. glass-reinforced polyepoxy or polyester curable composition) after fixing the electrode(s) and enveloping grouting material in place. In this connection, a pre-formed assembly of the electrode(s) and solid grouting material could conveniently be used. However, for physical robustness and convenience of installation it is preferred to use a pre-formed cover of suitably moisture-resistant material, for example extruded or moulded plastics materials such as unplasticised polyvinyl chloride, polystyrene, polyethylene, polypropylene, polyamide (e.g. Nylon 6, Nylon 6,6, Nylon 11, Nylon 12), polyepoxy resin, or fiber-reinforced versions of these. Glass or other) fiber-reinforced concrete may also be formed by extrusion or moulding to act as the cover, one such material being Cell-line G.R.C. (Trade Mark) as supplied by Cellite Selfix Co. Ltd. A suitable finish will be applied to render such a cover substantially non-porous and water resistant.

It will usually be preferable that at least part of the periphery of the cover is in contact with the said surface, thereby at least partly enclosing the electrode(s) and the grouting material. In most cases, it is advantageous that the cover substantially completely encloses the electrode(s) and the grouting material against the said surface.

Although flat electrodes on the surface of a flat layer of the grouting material could be used, it is preferred that the grouting material at least partly surrounds the electrode(s). Preferably, the grouting material completely surrounds at least part of the electrode(s), in which case it is preferred that the surface of the electrode(s) furthest from the said surface of the reinforced structure is covered by the grouting material to a depth of not more than 25 millimeters, preferably not more than 15 mm, more preferably not more than 10 mm, and especially to a depth of 1 to 5 millimeters. Preferably the grouting material substantially fills the space surrounding the electrode(s) between the cover and the said surface of the reinforced structure.

Preferably, the dimensions of the electrodes, the body of grouting material and the cover will be selected to enhance the maintenance of electrical contact between the electrode and the reinforcement. This may, for example, involve .keeping a necessary minimum moisture content in the grouting material around the electrodes and in the underlying reinforced structure. To this end, it may be desirable that the width of the individual electrode(s) lying substantially parallel to the said surface of the reinforced structure is not greater than the thickness of the grouting material between said surface and the surface of the electrode(s) closest thereto. However, electrodes may for example be 0.1 to 10 mm in width and the grout 1 to 25 mm in thickness. The ratio of the electrode width to the thickness of the grouting material should thus preferably be within the range from 1:0.1 to 1:250, more preferably from 1:1 to 1:100. The grout thickness referred to here does not include any further grouting material which may be applied during installation as aforesaid.

It may also be desirable that the cover extends beyond the electrode(s) to a distance at least 0.5 times and up to 100 times the electrode width. Preferably, the cover will extend beyond the two outermost electrodes (when two or more are enclosed) to a distance within the range from 0.1 to 100 times the minimum distance between adjacent electrodes, preferably 0.5 to 50, and more preferably 1 to 10 times that inter-electrode distance.

The grouting material is ionically conductive and preferably contains water. It preferably includes at least one hygroscopic (or deliquescent) material to assist in maintaining a desirable moisture content and hence a desirable level of electrical conductivity. Such materials include for example calcium chloride, or premixed commercially available materials such as the grout Thora CP (Trade Mark) supplied by the Thora Company. The ionic electrical conductivity as determined by the four pin probe method (described in a paper presented by R. P. Brown at "Corrosion 83" Symposium, Anaheim, Calfornia, U.S.A. during 18-22 April 1983 incorporated herein by reference) is preferably within the range from $10^{-5}$ to 0.02 S $cm^{-1}$, more preferably $4\times10^{-5}$ to 0.02 $Scm^{-1}$, and especially $6.6\times10^{-5}$ to 0.02 $Scm^{-1}$. Examples of potentially suitable grouting materials include a mixture of portland cement and fine aggregate mixed with water to produce a pouring consistency without segregation of the constituents.

The type of cement is chosen from those shown in Table 1, to suit the particular working environment of the anode assembly.

TABLE 1

Portland Cement Types and Basic Composition

| | Portland Cement Type | | | | |
|---|---|---|---|---|---|
| Compound | 1 | 2 | 3 | 4 | 5 |
| $C_3S$ | 53.7 | 58 | 62.3 | 53.6 | 42.0 |
| $C_2S$ | 19.9 | 16.2 | 12.5 | 17.2 | 28.8 |
| $C_3A$ | 11.4 | 7.1 | 2.8 | 14.0 | 14.0 |
| $C_4AF$ | 8.8 | 11.9 | 14.9 | 8.8 | 8.8 |

For example type 5 cement would be selected in those instances in which the anode assembly would be asked to work in a high sulphate containing environment.

Further to the above, inclusion of pozzolanic materials in the cement can be considered, for example the use of type IP cement which contains pozzolan to between 15 and 40% by weight of the total cement. Pozzolan is defined as a siliceous or siliceous-and-aluminous material which in itself possesses little or no cementitious value, but which in finely divided form will react with calcium hydroxide in the present of moisture.

Use of this type of grout material will have the added value that a degree of acid resistance is imparted to the grout, this being useful around the anode due to the electrochemically generated acidic by-products of normal operation.

Other examples of grouting materials include polymer-modified cement mortars, for example the commercially available materials such as: Sika Grout, Icement 503, ES08 and 508 as supplied by Sika InterCol; Excem as supplied by Celtite Selfix Ltd.; and calcium sulphate based plasters, e.g. plaster of paris. Preferred are those which are initially flowable, for convenient introduction into the apparats, and then tend to solidify.

The moisture-resistant cover is substantially moisture-impervious, for example fiber-reinforced concrete or polymeric material. It has a moisture vapor transmission rate of less than $10^3$, desirably less than $10^2$ preferably less than $10^3$ g mil per $m^2$ per 24 hours. The electrode(s) may, for convenience, be mechanically attached to the cover, which may for example be in the form of an elongate channel overlying at least one elongate electrode.

In an especially useful form of the apparatus according to this invention, (a) the cover channel overlies two or more electrodes each comprising a single wire substantially concentrically covered with one or more electrically conductive polymer compositions, each electrode having a finished diameter of 2 to 15 millimeters, (b) the electrodes are spaced apart by a distance of 0.3 to 5 cm (depending on the diameter of the electrodes), (c) the electrodes are surrounded by the grouting material with a thickness of 0.1 to 1 cm of grouting material between the said surface of the reinforced structure and the part of the electrode surface closest thereto and a thickness of 0.1 to 2.5 cm of grouting material between the part of the electrode surface furthest from the said surface of the reinforced structure and the cover, and (d) the cover extends laterally beyond the electrodes by 0.5 to 10 cm, preferably by 1 to 5 cm.

The invention has particular advantages when the cover is attached to the said surface of the reinforced structure independently of any attachment by way of the grouting material. Such independent attachment gives rise to an advantageous method of installation (which is another aspect of this invention), wherein the preformed cover is attached to the said surface of the reinforced structure so as to enclose the electrode(s) between the cover and the said surface, and the grouting material is thereafter introduced into the space enclosed between the cover and the said surface. In this case, the grouting material will preferably be flowable, at least initially, and will preferably become less flowable or non-flowable after introduction into the cover. It may be desirable, especially where there are surface irregularities (e.g. caused by poor shuttering leaving surface indentations and ridges in the hardened concrete surface) which may interfere with the electrical continuity of the system, to use an additional layer of ionically conductive material assisting the establishment and maintenance of electrical contact between the electrode(s) and the said surface of the reinforced structure. The additional layer may be present at the interface between the grouting material and the reinforced structure, and/or at the interface between the grouting material and the electrode(s), and will preferably comprise a conformable ionically conductive composition, for example a soft cementitious mortar or a flexible ionically conductive gel.

The localised or patterned application of the electrode(s), grouting material and cover to a reinforced structure provides benefits in terms of weight saving and efficient installation compared with methods requiring application of concrete or other overlayers over the whole surface of the structure to be protected. This aspect of the invention accordingly provides apparatus for inhibiting corrosion of the reinforcement in a reinforced structure of masonry or cementitious material, comprising a pattern of two or more assemblies located on a surface of the structure, each of which comprises (a) one or more, electrodes overlying a surface of the structure,
(b) a layer of ionically conductive grouting material arranged in a pattern corresponding with the pattern of the electrode(s) and, connecting the electrodes to the said surface,
(c) a moisture resistant cover having a moisture vapor transmission rate of less than $10^3$ g mil per $m^2$ per 24 hours overlying the electrode(s) and the grouting material, an edge portion of which cover extends partly around the electrode(s) and the grouting material towards the said surface of the reinforced structure, and
(d) means for connecting the electrode(s) to an electrical power source (e.g. as hereinafter described).

The invention includes a method of inhibiting corrosion of reinforcement in a reinforced structure of masonry or cementitious material, comprising applying cathodic protection current to the structure by means of apparatus as described above.

For some commercial uses, it may also be convenient to provide self-supporting assemblies of the electrode(s), grouting material and cover ready for installation, preferably including means for connecting the electrode(s) to those of other such assemblies to form an electrically linked group of such assemblies. The connection means could comprise suitable male/female connections at opposite ends of the assemblies, allowing butt fitting of the ends of the assemblies against one another, or could comprise wires and clamps or other connectors where small spaces between the ends of the assemblies are acceptable. The connection means may be constructed so as to facilitate correct alignment of the channel and electrode sections with one another. Such assemblies render possible a quick method of installation by simply attaching one or more such assemblies to the surface of a reinforced structure to be protected so as to establish electrical contact between the surface and electrode(s), preferably including the step of applying a conformable ionically conductive composition to the surface of the reinforced structure and/or to the surface of the grouting material before attaching the assembly or assemblies to the said surface.

A highly advantageous aspect of the present invention is that wherein the grouting material is additionally used to repair or replace damaged or missing parts of the underlying concrete of the reinforced structure, in addition to ionically connecting it to the protective electrodes. For example, the frequently damaged edges and corners of reinforced concrete bridge sections, pylons, or road joints may be repaired and protected against further corrosion of the reinforcement by (1) removing any existing covers or joint casings, (2) trimming the concrete to remove unsound material and/or provide room for the protective electrodes, (3) applying the electrodes and covers generally of the kinds hereinbefore described, and (4) filling the space between the cover and the concrete with the grouting material, in this case preferably a high strength cementitious compound, for example the aforementioned Excem.

BRIEF DESCRIPTION OF THE DRAWINGS

Specific embodiments of the invention will now be described by way of example with reference to the accompanying drawings, wherein:

Referring to FIG. 1, a section of concrete 1 can be seen with embedded steel reinforcement rods 2, which might represent, for example, a floor in a reinforced concrete building. Electrodes 3 are enclosed against the underside (or "soffit") of the concrete section by channel-shaped covers 4 of extruded ABS plastics material, which are filled with electrically conductive water-containing grouting material (omitted for clarity) which surrounds the electrodes and connects them to the surface of the reinforced concrete. As shown schematically, in operation a D.C. voltage of 3 to 12 volts (preferably about 6 volts) is applied between the electrodes 3 as anode and the reinforcing rods 2 as cathode, the resulting ionic current flow counteracting the tendency for the reinforcing rods to corrode. The channels 4 extend laterally beyond the electrodes to an extent (b) which retards drying of the grout and the concrete underlying the electrodes, thus maintaining the electrical connection between electrodes and reinforcement. The thickness (a) of grouting material between the electrodes 3 and the concrete is greater than the width of the electrodes 3 lying parallel with the concrete surface, which width in this example equals the diameter of the substantially circular cross-section of the electrodes. The channel covers 4 are attached to the concrete by suitable fasteners (not shown), for example masonry nails driven through the edge flanges 5 of the covers. The electrodes 3 may be appropriately spaced from the cover and the concrete by means of "spiders" made of any suitable material, preferably insulating plastics material, or may be attached to the cover for example as shown in FIG. 4. Flowable grouting material is then introduced to fill the channels enclosed by the covers, the viscosity of the grouting material being, or rapidly becoming, sufficiently high to prevent it from flowing out again.

Figure 2:
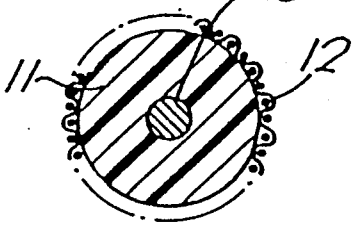
FIG. 2 shows in cross-section a preferred form of electrode for the apparatus of FIG. 1.

The preferred electrode shown in FIG. 2 comprises a conductive metal wire 10 surrounded by an adherent layer 11 of a carbon-filled electrically conductive polymeric composition, which constitutes the electrolytically active surface of the electrode. The wire 10 thus advantageously plays no part in the electrolytic processes of corrosion protection. A woven braid 12 is shown surrounding the conductive polymeric layer 11, but this braid may be omitted in practice.

Figure 3:
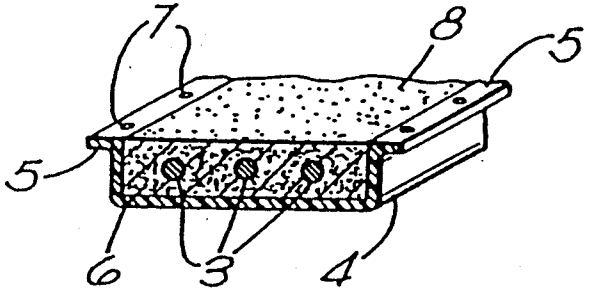
FIG. 3 shows in schematic perspective a self-supporting assembly of electrodes, grouting material and cover for the apparatus of FIG. 1.

FIG. 3 shows a self-supporting assembly of channel cover 4, electrodes 3, and substantially solid grouting material 6, which may be attached to the concrete surface by fasteners inserted through the holes 7 in the edge flanges 5. An ionically conductive gel or other material (not shown) may be applied to the surface 8 of the grouting material 6 to help establish electrical contact with the concrete and to compensate for any surface irregularities.

It will be understood that a sufficiently coherent grouting material 6 could be used to enable the cover 4 to be supplied separately or formed in situ after attachment of the assembly of the electrodes and grouting material alone to the concrete surface.

Figure 1:
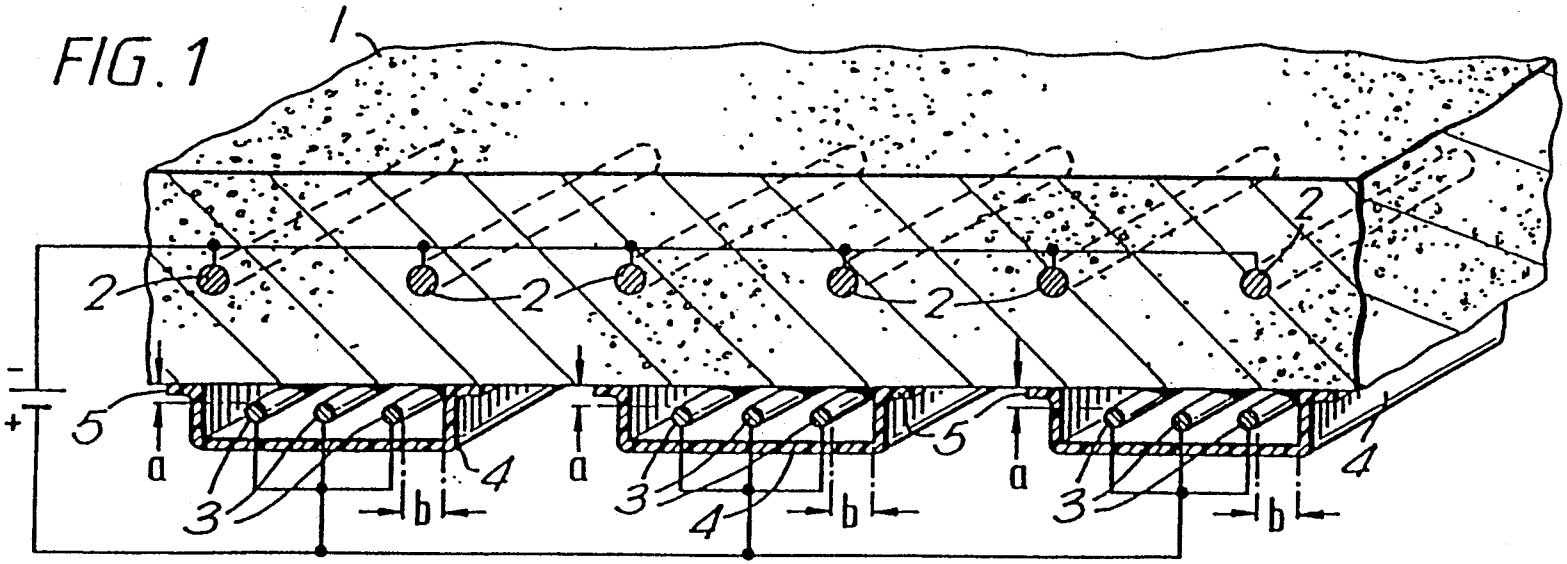
FIG. 1 shows schematically in perspective a section of steel-reinforced concrete with covered electrodes constituting apparatus according to this invention.
Figure 4:
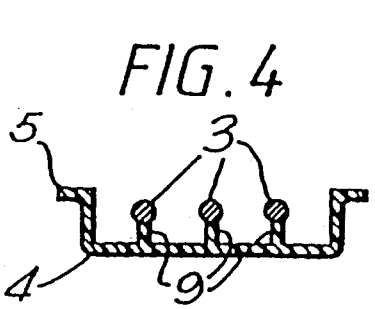
FIG. 4 shows schematically in cross-section a cover with attached electrodes.

FIG. 4 shows a self-supporting assembly of a channel cover 4 with the electrodes 3 attached thereto by webs 9 formed integrally with the plastics body of the cover.

Figure 5A:
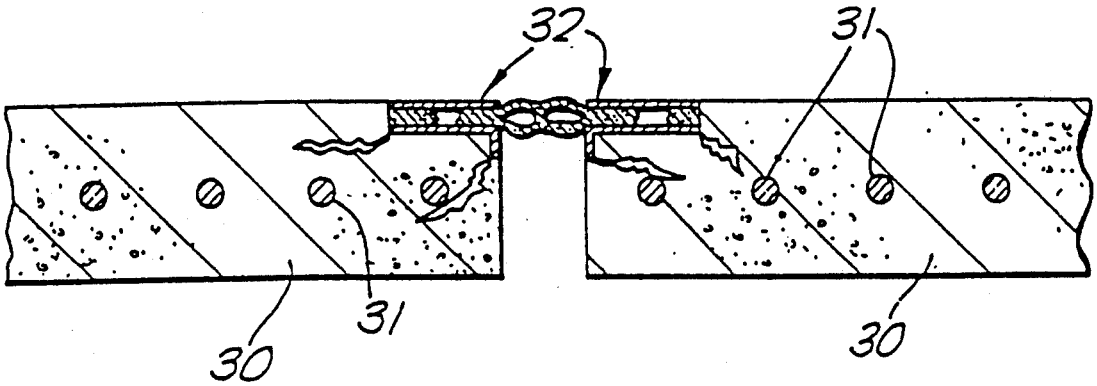
FIG. 5 shows schematically the stages of repairing damaged edges of a concrete road or floor joint.
Figure 5B:
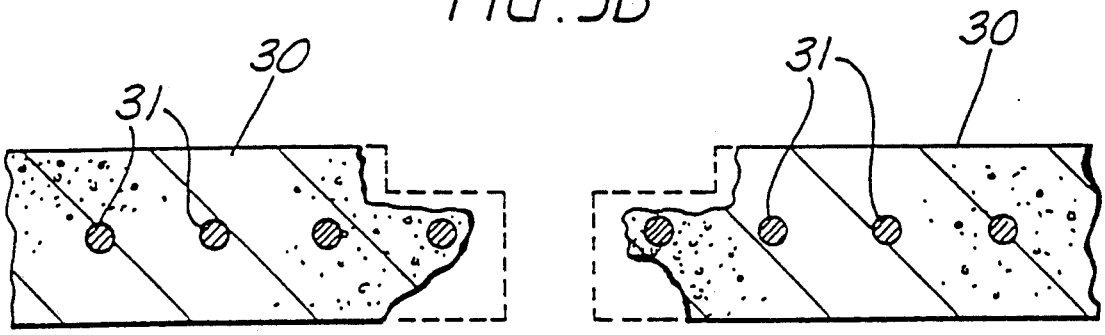
Figure 5C:
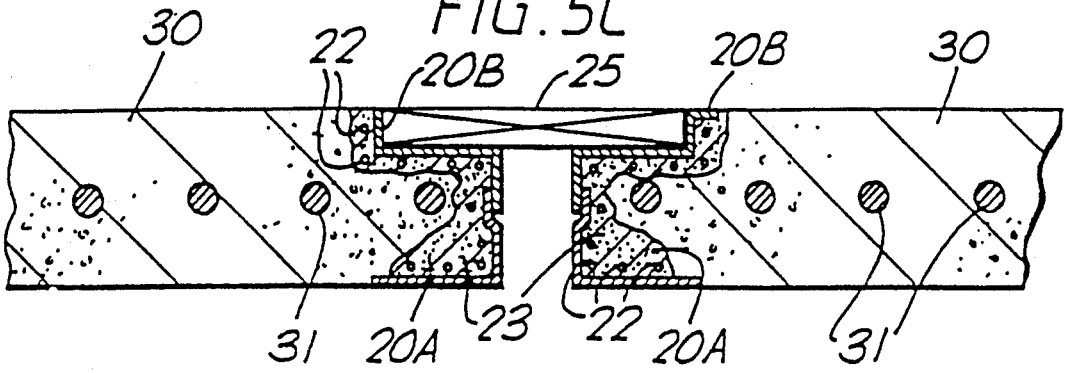

In FIG. 5A, a damaged bridge roadway joint is shown schematically comprising reinforced concrete sections 30 with rebars 31 and recessed jointing members 32, the edges of the sections having begun to crack. The jointing members 32 are removed and the concrete cut back to a profile shown in FIG. 5B, leaving room for the electrodes and covers and grouting material to form the intended profile for a new joint as indicated by the broken lines. FIG. 5C shows the installed covers in two parts 20A and 20B, with the electrodes 22 attached thereto by means omitted for clarity. The space between the covers and the road sections is filled with high strength Excem grout 23 under pressure, and a new joint cover 25 is provided. On connection of the electrodes to a suitable power source, cathodic protection is applied to the rebars 31. Similarly, repairs could be made to bridge columns or piers with the cover surrounding the damaged parts and filled with strong grout.

For the purposes of the present invention, it is generally preferred that the size of the cover and gas permeability of the grouting material are such that gases evolved at the electrodes in operation can escape sufficiently quickly to avoid unacceptable pressure build-up by diffusion through the grout to the edges of the enclosure formed by the cover. This tends to limit the size of cover and volume of grout. Such limitation of size is fortunately in keeping with another feature of the present invention, which preferably involves leaving enough of the concrete surface uncovered to permit wetting to replenish the absorbed water used up by electrochemical reactions or lost by evaporation.

Operating current, rate of gas evolution, cover size, volume and porosity of grout, spacing between covers, and the other spatial relationships already referred to can be brought into a harmonious working relationship by simple calculations based on the characteristics of the materials concerned in any specific application of the invention.

The invention is further illustrated by the following specific Examples, in which reference is made to FIGS. 6 to 10 of the accompanying drawings.

EXAMPLE 1

Figure 6:
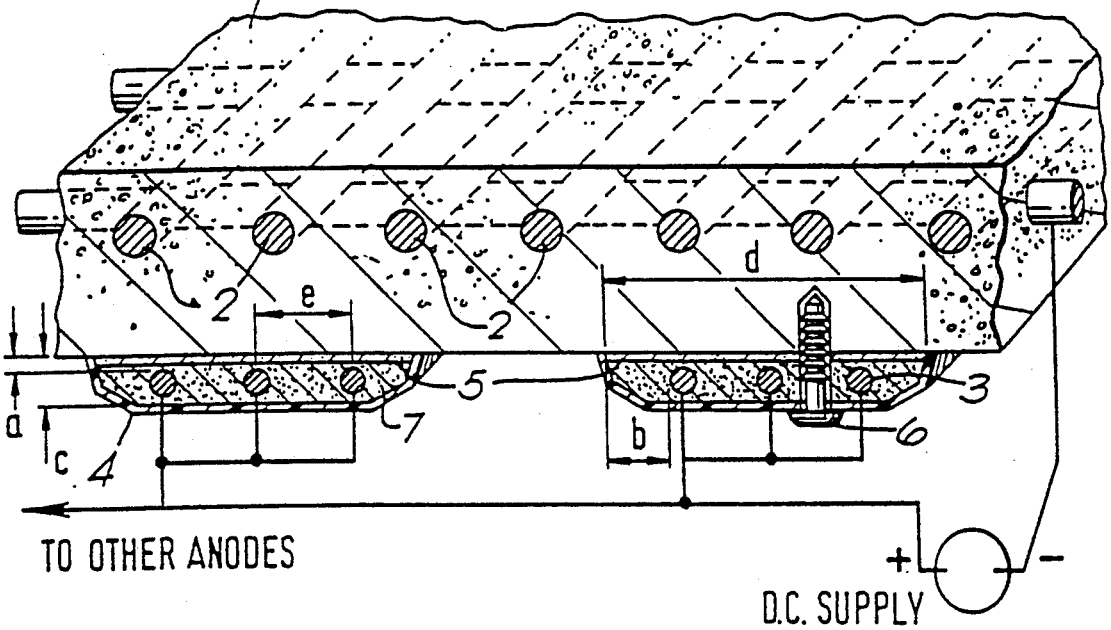
FIG. 6 is another perspective view of a section of steel reinforced concrete with an alternative embodiment of the anode assembly attached to the bottom of the cement slab.

Employing an unplastised poly vinyl chloride (PVC) polymer exhibiting the properties shown below, a channel profile as portrayed in (4) FIG. 6 was melt extruded. This channel had a wall section thickness of 1 mm and an internal width (d) of 80 mm and an internal depth of (c) 18 mm.

Properties of the unplasticised PVC polymer used in Example 1

Water Vapor Transmission Rate @40 C$=1\times10-4$ kg,im/$M^2$, 24 hrs

Volume Resistitivity$=10^{13}$ ohm cm

Following extrusion the channel section produced was cut into 1000 mm lengths, these forming the outer section of the anode assembly of this invention.

To the internal surface of the channel section small UPVC clips were affixed in three parallel lines at 200 mm centers. These clips were attached on the back surface in order that an anode spacing of 20 mm (e) FIG. 6 results.

Conductive polymer anode as described by U.S. Pat. No. 4,502,929 with an external diameter of 8 mm, sold under the trade name Ferex 100, was cut into 900 mm lengths.

Three such anode lengths were then bussed together at one end to a 500 mm length of high molecular weight polyethylene insulated 12 AWG lead wire, such that the anodes were connected in parallel. Over this electrical connection a water impervious seal was produced by injection moulding. This was done using medium density polyethylene resin and such that the bussed connection was completely encapsulated. The finished thickness of the encapsulated section was 12 mm and width 46 mm, the encapsulation extending 20 mm down the polymeric anode.

The completed parallel anode assembly was then clipped into the prepared PVC channel by means of the small clips previously described. At the other cut end of each of the three anode sections, an environmental seal was provided employing 50 mm lengths of an adhesive lined heat shrinkable polyolefine tubing. It is necessary to seal both ends of the anode cut sections in order to prevent the copper core becoming anodically active. The separation (a) FIG. 6 of the anode to the PVC channel lower edge was 7 mm.

After assembly of the anode/channel element, the inside was filled with a cementitious mortar, encapsulating the anode along its entire length. This was done employing a vibration table in order that good void filling was achieved.

The cementitious mortar adopted in this procedure was as shown in below. A small amount of chopped polypropylene fiber sold under the trade name of Fibremesh as sold by. Fibremesh Ltd, Europe, was added to enhance the flexural strength of this cured mortar. The depth of the cementitious fill was 16 mm.

Composition of cementitious mortar used in Example 1

| | | |
|---|---|---|
| Type IV cement | 1 part | |
| Sand (fine) | 3 parts | |
| Polypropylene fibre | 0.1% | note 1 |
| Sulphonated aryl alkylene superplasticiser (ICI Mighty 150) | 1.0% | note 1 |
| Water added to provide a water cement ratio of | 0.3 | |

Note 1:
Percentage values shown are percent by weight of cement content.

After loading the channel the cementitious fill was allowed to cure for 28 days at 100% RH and 21° C. prior to use.

Anode sections described above were attached to a prepared soffit of a 3000 mm×1000 mm test slab. This test slab was produced such that a standard two layer steel reinforcement cage comprising 20 mm diameter bars was configured with a cover of 35 mm top and bottom, this centrally located in a slab section thickness of 250 mm.

Salt (NaCL) solution 3% by weight of water was applied periodically to the upper surface of the test slab over a 6 month period, this was done in order to engineer the existence of a corrosion macro cell on the reinforcement. Native potentials as measured by a surface mounted copper/copper sulphate electrode (CSE), were prior to salt application −190 mV and after 6 months −487 mV.

The attachment of the anode assembly comprised a 3–5 mm thick cement mortar to the cured cementitious fill surface, then pushing this against the slab soffit. Mechanical plastic fasteners 6 were passed through pre-drilled holes in the anode assembly and hammered into correspondingly smaller holes in the slab section. FIG. 6 (6). Prior to anode attachment latents and surface dirt was removed from the slab soffit by means of a needle gun and high pressure water washing.

Anode sections were applied to the surface at 300 mm spacing and in parallel across the slabs 100 mm width. Following a 7 day cure period for the bonding mortar, the anode sections were interconnected to a common buss lead by means of their respective lead wires. The buss wire was in turn connected to a DC transformer rectifier capable of operating under constant voltage conditions. The steel reinforcement was connected to the negative terminal of the rectifier unit, so completing the electrical circuit. Prior to conducting this last step, the electrical continuity of the reinforcement was established and shown to exhibit a <0.5 DC resistance between all points on the cage.

After powering the cathodic protection arrangement described the electrode potentials recorded on the reinforcement with time were as shown in Table 2. These indicate clearly that the reinforcement is indeed cathodically protected with a good measure of cathodic polarisation on the steel throughout the test period.

TABLE 2

| Time | Applied DC Voltage (V) | Effective Anode Surface Current mA/M² | Electrode Potentials (CSE) Steel Potential ON (mV) | OFF mV(1) | 4 hr depol |
|---|---|---|---|---|---|
| 0 | 0 | 0 | 0 | −487 | 0 |
| 24 hrs | 3.2 | 42 | −980 | −550 | 112 |
| 1 week (2) | 3.2 | 42 | −1050 | −609 | 180 |
| 3 months | 2.8 | 32 | −901 | −664 | 154 |
| 6 months | 2.8 | 30 | −890 | −689 | 138 |
| 12 months | 2.8 | 26 | −856 | −671 | 114 |

Note 1:
"Instant Off" potential
Note 2:
Following this measurement applied voltage reduced to 2.8 volts D.C.

EXAMPLE 2

Figure 7:
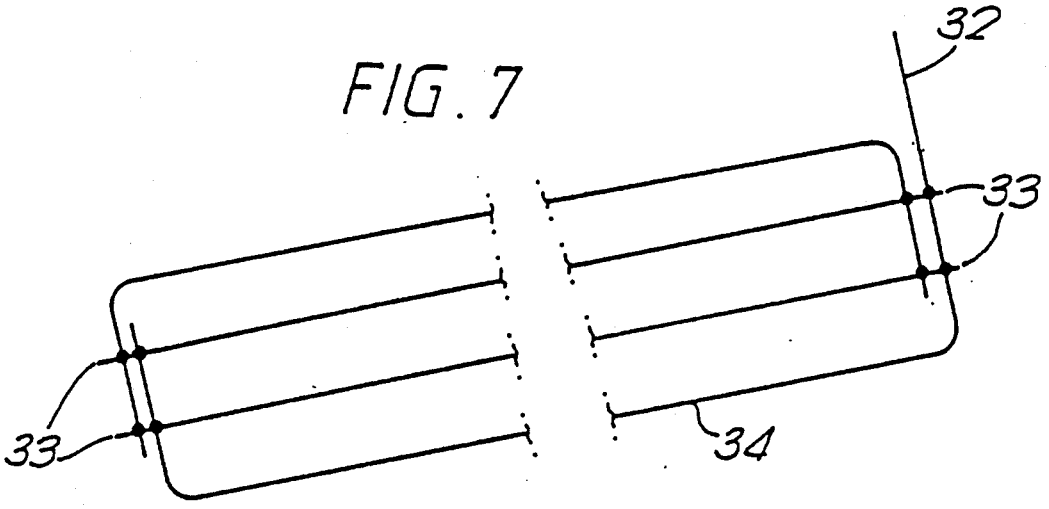
FIG. 7 shows an array of titanium wires which may replace the conductive anode strands in the anode assembly of FIG. 6.

Employing the channel as described in Example 1 the conductive polymer anode strand was replaced with 3 mm diameter Irridium catalysed titanium wire (34) FIG. 7. Four 900 mm long sections of the titanium anode were welded together at both ends to provide an assembly as shown in FIG. 7. Spacing between the individual anode wire elements was 12 mm.

The titanium anode assembly was located and held into position by the small PVC clips previously described. After fixing, the anode was 9 mm from the channel lower edge portion this corresponding to dimension (a) FIG. 6. The bent section (32) FIG. 6 of the titanium anode, was positioned such as to exit the channel via a pre-drilled hole in the side wall. This it is intended will be used in the finished article to provide the means of electrical interconnection of the anode element to the power supply.

Into the channel so encapsulating the titanium anode, a cementitious mortar was compacted and vibrated into place. The formulation in this instance of the cementitious mortar being shown in below. In this example calcium aluminate cement is adopted, this being done since upon hydration no calcium hydroxide is formed. This feature distinguishes it from the portland cements and improves the acid resistance of the cured material.

Composition of cementitious mortar used in Example 2

| | | |
|---|---|---|
| Calcium Aluminate Cement | 1 part | |
| Fine sand | 2.5 parts | |
| Polyproplylene fibre | 0.1% | Note 1, Table 2 |
| Naphthalene Formaldehyde condensate "Lomar D" Diamond Shamrock | 0.25% | Note 1, Table 2 |
| Water added to provide a water:cement ratio | 0.35 | |

After filling of the channel section fully void filling around the anode elements, the mortar was cured at 100% RH and 21° C. for 28 days. The finished mortar section thickness was 16 mm.

Anode elements were attached to the vertical face of a precast reinforced concrete wall section the characteristics of which are shown in below.

The anode sections were attached to the prepared surface as previously described employing a cement mortar based upon calcium aluminate cement. Anode spacing adopted on the wall section due to the light reinforcement present was 400 mm between anode sections.

Characteristics of anode elements used in Example 2

| | |
|---|---|
| Reinforcement density | 0.68 sq m steel surface sq meter of concrete surface |
| Reinforcement diameter | 10 mm |
| Chloride content (Cl—) | 2.8% by weight of cement |
| Carbonation depth | 7 mm |
| Volume resistivity (average) | 26000 ohm cm |
| Cover over steel (average) | 25 mm |
| Native potential (average) | −360 mV silver/silver chloride |

Into the slab section, prior to conducting the trial silver/silver chloride ref electrodes were positioned at the depth of the steel reinforcement. These were cast into excavated holes and cast in an OPC mortar containing an equivalent chloride ion content as the surrounding concrete.

With the steel reinforcement connected to the negative terminal of a constant voltage DC transformer rectifier and the anodes to the other terminal. In this instance the individual anode elements were all interconnected in parallel. Results of this experiment with time as shown in Table 3, from this it can be seen that the reinforcement is adequately cathodically protected.

TABLE 3

| Time | Applied DC Volts (V) | Effective Anode Surface Current mA/M$^2$ | Electrode Potentials (1) Steel Potential OFF (mV) | 4 Hr depolorisation |
|---|---|---|---|---|
| 0 | 0 | 0 | −360 | 0 |
| 1 wk | 2.8 | 51 | −500 | 121 |
| 3 months (2) | 2.8 | 50 | −542 | 168 |
| 8 months | 2.60 | 38 | −504 | 160 |
| 1 year | 2.60 | 36 | −511 | 147 |

Note 1:
Silver Chloride electrode potentials
Note 2:
Voltage applied reduced to 2.6 volts

EXAMPLE 3

A PVC channel was extruded as for Example 1. However, a further elongated compartment running along one edge was incorporated. This had a width of 20 mm and was the same depth as the channel section. Following extrusion, the channel was cut into 1000 mm lengths and as in Example 1, small PVC cable clips attached to the inside surface of main channel section.

Inside the channel a titanium catalysed anode array was attached, as described in Example 2. However, a 100 mm section of one of the titanium anodes was removed at the central position along its length, the two cut ends being supported in clips.

Within this area a 10 mm diameter silver-silver chloride reference electrode WE10 type supplied by Silvion Ltd, was attached. The whole assembly of anode and reference electrode was then encapsulated in a cementitious mortar of the type used in Example 2.

The reference electrode lead wire was exited through the partition between the main channel and the elongate compartment, through a pre-drilled hole. This wire was held in position along the compartment by push fit PVC cable clips and terminated at the end of the channel that had the bent portion of titanium anode (32) FIG. 7. Both the titanium anode section (32), the reference electrode lead wire, and an additional black 14 AWG lead wire, were then connected to a three pin plug, this adhesively connected to the PVC channel section side wall. The additional black wire to be used as the reference electrode negative, for attachment to the reinforcement, also being clipped into the elongate compartment, the latter now acting as an integral wire conduit within the anode assembly and total system.

The finished anode assembly it is intended would be used in conjunction with similar sections not containing reference electrodes, hence, providing the array with an integral means of system monitoring. All wires for the system being contained within the integral conduit and matching PVC cover over the plug and socket attachments on the channel. This enhancing the aesthetics, important when used in building applications open to the public. Inherent in this example also in the additional safety of having all electrical wires within rigid conduits.

EXAMPLE 4

Figure 8:
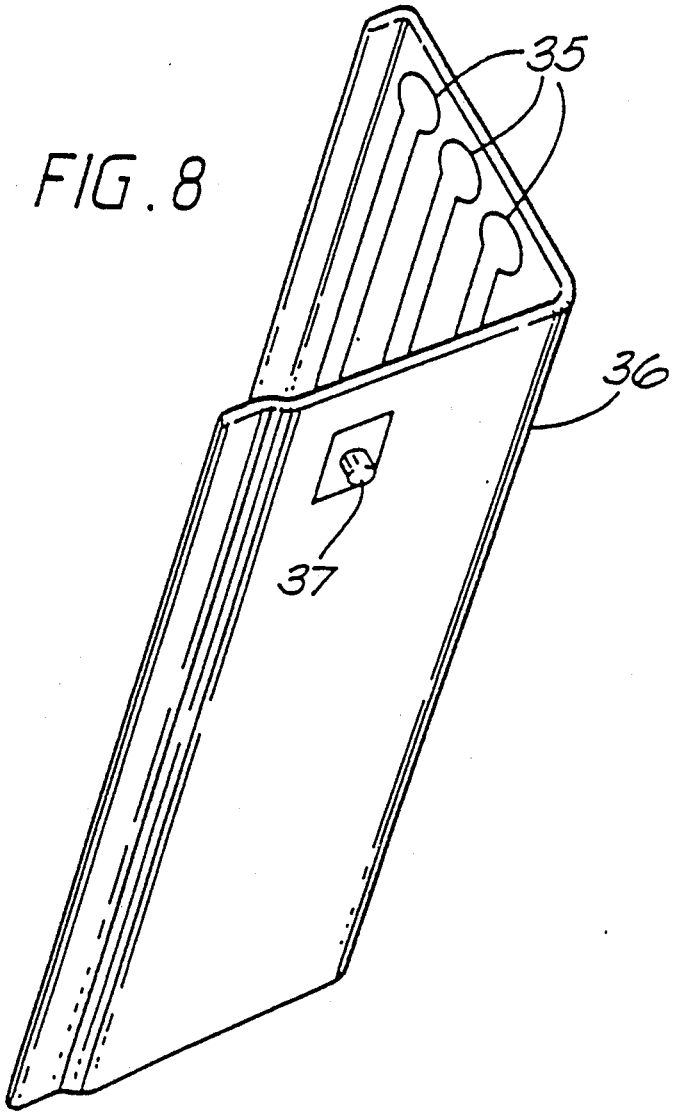
FIG. 8 is a perspective view of a glass fiber reinforced concrete section with a conductive polymer anode strand attached thereto.

A glass fiber reinforced concrete (GRC) section was produced of section, size and configuration shown in (36) FIG. 8. The cement mortar adopted in the production of this section being as shown on below.

Manufacture of the GRC element was conducted by hand spraying the mix into a plastic coated mould. The slurry being prepared prior to spraying on a Tumac THB-100 high speed mortar-mixer. After spraying to produce the desired section thickness of 15 mm, the mould was positioned on a vacuum table to vacuum dewater the section. This increases the density of the matrix and removes excess water from the section.

Composition of cement mortar used in Example 4

| | | |
|---|---|---|
| Sulphate resistant Portland Cement | 30 kg | |
| Zone 4 sand | 10 kg | |
| Expanded Perlite (250 kg/cm$^3$ | 2 kg | |
| Glass (added at the gun nozzle) 2.6 gm/cm$^3$ density 80 G Pa modulus | 2.5 kg | |
| Naphthalene sulphate air entrainment agent | 1.0% | Note |
| Water added to achieve a water cement ratio | 0.4 | |

Cure of the section produced was conducted at 100% RH and 20° C. for 28 days in a fog room environmental chamber. Properties of the finished cured section as measured on test specimens made at the same time, and cured under identical conditions were as shown in below.

Properties of finished cured specimens as per Example 4

| | |
|---|---|
| Modulus on Rupture N/mm$^2$ | 42 |
| Ultimate Tensile Strength N/mm$^2$ | 15 |
| Young's Modulus KN/MM$^2$ | 21.4 |
| Impact Strength 120 D (Nmm/mm$^2$) | 22.5 |

Following the 28 day cure period polypropylene cable clips were used to attach a conductive polymer anode strand (35) FIG. 8 of 8 mm diameter, similar to that used in Example 1. The anode strand was configurated in a serpentine arrangement running up and down the length of the GRC section (36) FIG. 8. On the two cut ends of the anode strand two 14 AWG high molecular weight polyethylene insulated wires were attached by crimping onto the copper core of the anode. Over this crimped connection a heat shrinkable adhesive coated 100 mm long tube was thermally recovered to environmentally protect the connection. The two lead wires were then taken out through a predrilled hole in the GRC (37) FIG. 8 and connected to a socket assembly. This socket assembly was in turn attached to the GRC outer surface through the use of an epoxy based adhesive.

With the anode and electrical socket in position, a two component polyepoxy coating was sprayed on to the outer GRC surface. The coating thickness after several spray applications was measured to the 0.8 mm, the general properties of the coating being as shown in below.

General properties of the polyepoxy coating used in Example 4

| | |
|---|---|
| Water vapour tranmission rate | 1.041 kg, cm/m$^2$ 24 hr |
| Elongation to fracture | 3.8% |
| Tensile strength | 50 MPa |
| Volue resistivity | $5 \times 10^2$ ohm cm |

A vertical building column exhibiting extensive chloride induced corrosion based deterioration was repaired as follows. All the cracked and delaminating concrete was removed from the structure using a pneumatic tool. After removal of this, concrete exposed steel was cleaned by grit blasting to a clean metal finish. All other concrete surface was treated with a needle gun to remove the outer 1–2 mm, exposing aggregate to provide a good mechanical key for the repair mortar. The structure was then finally washed with high pressure water to remove dust and other debris.

On two of the exposed steel reinforcement sections, cathode connections were made employing the thermite brazing technique. At these locations two WE100 Silvion reference electrodes were also located, held in position by nylon cable ties to the steel reinforcement. To each of the reference electrode locations a corresponding negative connection was made to provide the complete monitoring circuit.

With the column preparation completed, two of the above described GRC elements were arranged around the column and fixed into position with plastic coated screws. The annular gap between column concrete surface and that of the inside surface of the GRC was 35 mm. On the two vertical joints of the GRC sections a polysulphide calking compound was applied, this turn coated with a thick fast cure epoxy adhesive.

Upon cure of the two joint sections a free flowing microconcrete was poured into the gap between the GRC and column. This concrete providing the repair around exposed steel, the electrolyte for operation of the CP system and means of bonding the GRC to the column in the long term. The GRC in this instance provides not only an integral component of the anode assembly but architecturally acceptable permanent framework for the concrete repair.

Cure of the microconcrete was effected for a 28 day period prior to envisaging the GP system. With the system under power operating at 2.9 volts constant voltage condition, the 4 hour depolarisation value after 3 months of operation was recorded as 167 mV and 182 mV on the two reference electrodes. This demonstrating a good measure of cathodic activity on the steel reinforcement.

EXAMPLE 5

Employing the GRC fabrication technique described in Example 4, sections were made that corresponded to the outer profile of a full road joint for a slab section thickness of 450 mm. Each side of the joint being composed of two GRC sections, (20A) and (20B) FIG. 5C.

To the cured inside surface of the GRC a titanium metal mesh anode sold under the trade name of Elgard 210, this being platinum catalysed. Attachment of the anode in this instance being such that a=2 mm gap exists between the anode and the GRC. Flat 5 mm×1 mm catalysed titanium strips are run the length of the GRC and welded to the mesh at 200 mm intervals.

as with the anode lead wires of Example 4, this titanium strip was bent and passed through the GRC and terminated in a socket connector. Coating of the outside surface with an epoxy gel coat to a thickness of 0.6 mm completes the anode assembly.

Figure 9:
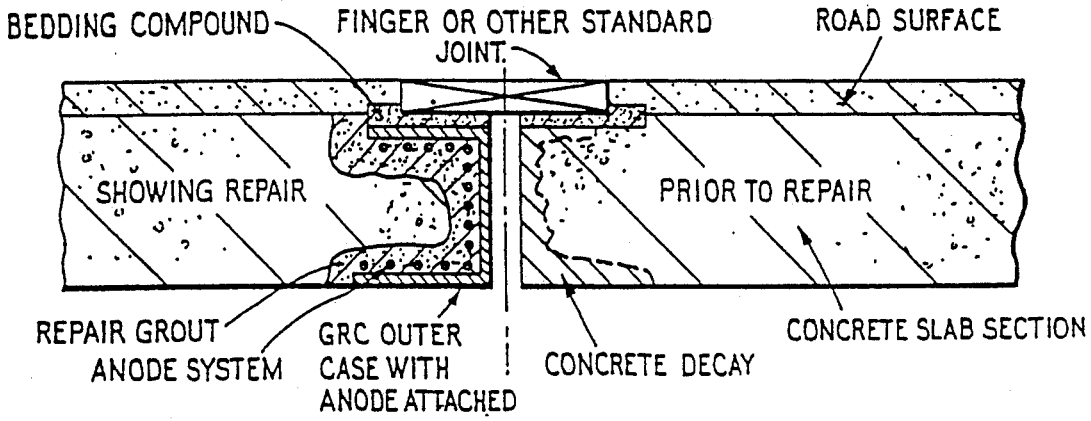
FIGS. 9 and 10 are elevational views of bridge joint section repairs using glass reinforced concrete sections of the type shown in FIG. 8.
Figure 10:
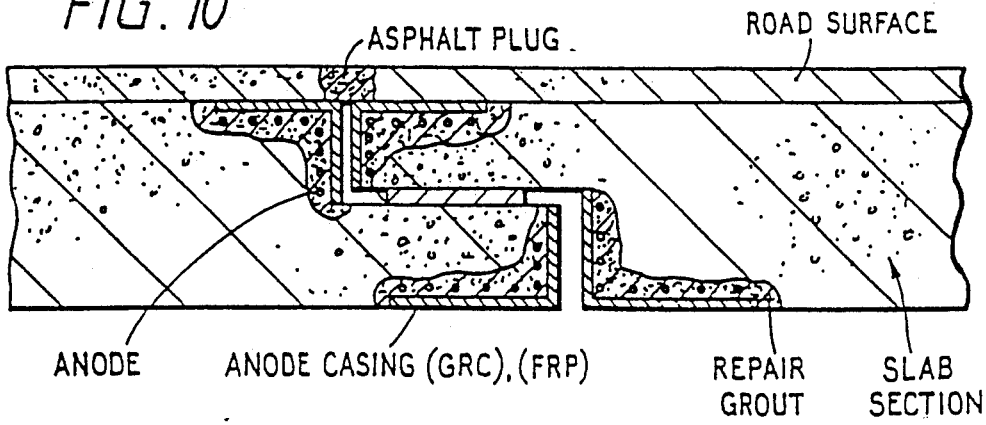

GRC sections of this type provide a useful way of providing permanent formwork and cathodic protection to bridge joint section repairs, as further illustrated in descriptive FIGS. 9 and 10.

Various modifications can be made to the foregoing without departing from the scope of the invention.

For example, the cover aforesaid can be constructed from a plurality of cover sections. These cover sections can be connectable one to the other by means of an overlapping connection, a push-fit connection, or any other convenient means of interconnecting one section to another. In order that a continuous length of apparatus of the invention can be provided to extend over any convenient desired surface of structure to be protected, the cover of the apparatus can be constructed in various components, for example in-line connecting pieces, right angle or elbow pieces, T-pieces or cross-pieces and various other pieces which allow changes in direction and from one plane to another plane, for example a piece of cover extending along the underside of a beam could be provided with an external corner section to allow it to proceed up the outer surface of the beam. Many other types of cover section can be provided.

The invention is, of course, applicable to electrodes of any convenient metal or other conductor or partial conductor.

Metal anodes used in the apparatus of the invention can be joined together by any convenient means which will provide electrical continuity. As examples there can be welding, for example spot welding, crimping, clamping with terminals, or the like.

The pre-formed components of the cover can include compartments specifically designed to allow the incorporation of reference cells at desired locations in order that monitoring of the components and other system can be carried out in situ and conveniently without having to make physical or electrical special entry into the system.

In order that supply and monitoring cabling can be conveniently accommodated close to the apparatus of the invention, the cover can include means for arranging for said cable to be disposed close to the cover. For example, the cover can include one or more integral conduits. The or each conduit can be closable to protect the cabling. Clips may be included to secure the cabling to the covering material.

Instead of the covering material being pre-formed, it can, if desired, be formed in situ. For example, one or more members could be secured to basic concrete of structure to be protected and then a covering sheet arranged to extend between that strip and the material of the concrete or between two such strips adhered to the concrete to form the cover which encloses the anodes within the cementitious material.

Desirably, in applying the apparatus of the invention to concrete to be protected, the anodes are initially embedded in a first portion of ionically conductive cementitious material upon or within the cover and, during installation of the apparatus a second portion of ionically conductive cementitious grouting material is applied to the structure to be protected and/or to the first portion and that second portion sandwiched between the first portion and the structure, the cover being urged towards the structure, as by fasteners such as bolts of non-conductive material, to compress said second portion to ensure a continuous layer of ionically conductive cementitious material between the anodes and the surface of the structure to be protected.

Many other variations are possible within the scope of the following claims.

I claim:

1. A reinforced structure of masonry or cementitious material having apparatus for inhibiting corrosion of reinforcement thereof, comprising a pattern of two or more assemblies located on a surface of the structure, each of which comprises:

(a) one or more electrodes overlaying a surface of the structure (b) ionically conductive cementitious grouting material connecting the electrode(s) to the said surface; and (c) a moisture-resistant cover having a moisture vapor transmission rate of less than $10^3$ g mil per $m^2$ per 24 hours overlying the electrode(s) and the grouting material, an edge portion of which cover extends at least partly around the electrode(s) and the grouting material towards the said surface of the reinforced structure.

2. A structure as claimed in claim 1, wherein the cover substantially completely encloses the electrode(s) and the grouting material against the said surface.

3. A structure as claimed in claim 1, wherein the grouting material completely surrounds at least part of the electrode(s).

4. A structure as claimed in claim 3, wherein the surface of the electrode(s) furthest from the said surface of the reinforced structure is covered by the grouting material to a depth of not more than 25 millimeters.

5. A structure as claimed in claim 1, wherein the electrode(s) comprise(s) one or more electrical conductor wires embedded in an electrically conductive polymeric composition, or valve metal wire coated with an electrocatalytic coating.

6. A structure as claimed in claim 1, wherein the width of the individual electrode(s) lying substantially parallel to the said surface of the reinforced structure is not greater than the thickness of the grouting material between the said surface and the surface of the electrode(s) closest thereto.

7. A structure as claimed in claim 1, wherein the cover extends beyond the electrode(s) to a distance at least 0.5 times and up to 100 times the width of the individual electrode(s).

8. A structure as claimed in claim 1, wherein the grouting material also serves to repair or replace portions of the underlying concrete structure.

9. A structure as claimed in claim 1, wherein the electrode(s) is or are mechanically attached to the cover by means other than the grouting material.

10. A structure as claimed in claim 1, wherein the cover is attached to the said surface of the reinforced structure independently of any attachment by way of the grouting material.

11. A structure as claimed in claim 1, comprising an additional layer of ionically conductive material assisting the establishment and maintenance of electrical contact between the electrode(s) and the said surface of the reinforced structure.

12. A structure as claimed in claim 1, wherein electrical connection means are incorporated in the said cover.

13. A structure as claimed in claim 1, wherein the cover comprises an elongate channel capable of holding electrical wires separately from the grouting material and electrode(s).

14. A method of inhibiting corrosion of reinforcement in a reinforced structure of masonry or cementitious material, comprising applying cathodic protection current to the structure by means of apparatus according to any of claims 1 to 13

15. A method of repairing a reinforced structure of masonry or cementitious material and providing it with a cathodic protection system, comprising:

(a) removing any unsound masonry or cementitious material and if necessary trimming the remaining structure to provide a profile suitable for the following steps, (b) attaching to the a surface of the structure at least one assembly which comprises at least one electrode and a preformed cover having a moisture vapor transmission rate of less than $10^3$ g mil per $m^2$ per 24 hours so as substantially to enclose the electrode(s) between the cover and the said structure, (c) introducing ionically conductive masonry or cementitious grouting material into the space enclosed between the cover and the said structure, and (d) causing or allowing the grouting material to harden; thereby connecting the electrode(s) to the said structure and repairing or replacing portions of the said structure.

16. A method as claimed in claim 14, wherein the cover is pre-formed.

17. Apparatus as claimed in claim 1 wherein said cover includes in-line sections, right angle sections, and sections which allow changes in direction from one plane to another.

18. A pre-formed article for application to the surface of a reinforced structure to inhibit corrosion of the reinforcement therein, the article comprising:

(a) one or more electrodes capable of serving as active anode(s) in operation, (b) ionically conductive grouting material in contact with the electrode(s) which grouting material is capable of permitting the electrochemical reactions necessary to inhibit corrosion.

(c) a moisture-resistant cover having a moisture vapor transmission rate of less than $10^3$ g mil per $m^2$ per 24 hours extending at least partly around the electrode(s) and grouting material, an edge portion of which cover will extend towards the surface to which the article is to be applied in use, and optionally, (d) electrical connector(s) for connecting the electrode(s) to a power supply and/or to each other in use, and (e) means for mechanically attaching the cover to the reinforced structure.

19. A structure as claimed in claim 3, wherein the surface of the electrode(s) furthest from the said surface of the reinforcing structure is covered by the grouting material to a depth of not more than 15 millimeters.

* * * * *